US008272711B2

(12) United States Patent
Suzuki

(10) Patent No.: US 8,272,711 B2
(45) Date of Patent: Sep. 25, 2012

(54) RECORDING TARGET MEDIUM AND RECORDING APPARATUS

(75) Inventor: Katsuhito Suzuki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 335 days.

(21) Appl. No.: 12/645,362

(22) Filed: Dec. 22, 2009

(65) Prior Publication Data

US 2010/0165036 A1 Jul. 1, 2010

(30) Foreign Application Priority Data

Dec. 26, 2008 (JP) ..... 2008-332958

(51) Int. Cl.
*B41J 29/38* (2006.01)

(52) U.S. Cl. ..... 347/16; 347/101; 347/106; 347/107

(58) Field of Classification Search ..... 347/16, 347/101, 104–108
See application file for complete search history.

(56) References Cited

U.S. PATENT DOCUMENTS 6,460,993 B2 * 10/2002 Pilu ..... 347/107

FOREIGN PATENT DOCUMENTS

JP 2005-082262 A 3/2005
JP 2007-130769 A 5/2007

* cited by examiner

*Primary Examiner* — Juanita D Jackson
(74) *Attorney, Agent, or Firm* — Kilpatrick Townsend & Stockton LLP

(57) ABSTRACT

A recording target medium includes a base material, a recording portion, and a guided-array portion. The recording portion is formed on or at one surface of the base material. The recording portion includes an ink-accepting layer. The guided-array portion is formed on the base material at a side opposite to an observation side of the recording portion.

22 Claims, 7 Drawing Sheets

RECORDING TARGET MEDIUM AND RECORDING APPARATUS

CROSS-REFERENCES TO RELATED APPLICATIONS

Priority is claimed under 35 U.S.C. §119 to Japanese Application No. 2008-332958 filed on Dec. 26, 2008 which is hereby incorporated by reference in its entirety.

BACKGROUND

1. Technical Field

The present invention generally relates to a recording apparatus such as an ink-jet printer and to a recording target medium. In particular, the invention relates to a technique for improving positional precision in recording on a recording target medium.

2. Related Art

Many existing recording apparatuses, such as many printers, transport a recording target medium during the recording process. If a recording target medium meanders or inclines during transportation, the quality of the recorded image may be degraded. For example, printed letters in small font may be blurred. An extra-fine ruled line may be distorted due to discontinuity and/or poor linearity. To avoid such quality degradations, high positional precision is desirable in recording. A technique for improving positional precision in recording on a recording target medium is disclosed in JP-A-2005-82262. In the disclosed art, left/right guide members are provided on a printer.

However, the means disclosed in JP-A-2005-82262 has the following disadvantages. It is difficult to exactly position the guide members to align both edges of a recording target medium whose shape is susceptible to change without leaving a gap between the guide members and the recording target medium. For example, it is difficult to align the guide members with plain paper or photo paper, either of which change shape easily, with perfect positional precision. The same difficulty exists in trying to align a recording target medium with rough and/or uneven edges.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In order to address the above-identified problems without any limitation thereto, the invention provides, as various aspects thereof, a recording target medium and a recording apparatus having the following novel and inventive features.

APPLICATION EXAMPLE 1

First Aspect

A recording target medium includes a base material, a recording portion that is formed on or at one surface of the base material, and a guided-array portion that is formed on the base material at a side opposite to an observation side of the recording portion. The recording portion includes an ink-accepting layer. Having the above structure, a recording target medium according to the first aspect of the invention is transported along its guided-array portion. Therefore, the transportation direction of the recording target medium is accurately controlled in a fixed direction. For this reason, positional precision in the recording of an image or the like on the recording target medium may be enhanced.

APPLICATION EXAMPLE 2

In the structure of the recording target medium according to the first aspect of the invention, it is preferable that the guided-array portion have the shape of an array of convex semi-cylinders, concave semi-cylinders, triangles, convexes, or concaves. Since the recording target medium can include one of the above shapes, the guided state may be maintained with greater reliability.

APPLICATION EXAMPLE 3

In the preferred structure of the recording target medium described above, the guided-array portion can be colored. For example, if the color of the guided-array portion is white, the sense and/or degree of whiteness of the recording target medium and its glossiness may be enhanced.

APPLICATION EXAMPLE 4

Second Aspect

A recording apparatus for performing recording on a recording target medium includes a supporting section that supports the recording target medium; and a guiding-array portion that is formed on the supporting section. The guiding-array portion guides the guided-array portion of a recording target medium according to the first aspect. Having the above configuration, the recording apparatus according to the second aspect of the invention makes it possible to accurately control the transportation direction of a recording target medium in a fixed direction. For this reason, positional precision in the recording of an image or the like on the recording target medium may be enhanced.

APPLICATION EXAMPLE 5

It is preferable that a recording apparatus according to the second aspect of the invention further include a pressing section that presses the recording target medium against the guiding-array portion. Since the recording apparatus preferably has the above configuration, the pressing section ensures engagement between the guided-array portion and the guiding-array portion (e.g., lenticular engagement). Therefore, the transportation direction of the recording target medium is accurately controlled in a fixed direction with greater reliability. For this reason, positional precision in the recording of an image or the like on the recording target medium may be further enhanced.

APPLICATION EXAMPLE 6

In the configuration of a recording apparatus having the preferred configuration, the pressing section can be a roller that rotates in a rotation direction that agrees with a direction of transportation of the recording target medium. With such a configuration, since the roller rotates toward the transportation direction of the recording target medium, it is possible to reduce driving power that is required for transporting the recording target medium.

For a fuller understanding of the nature and advantages of the present invention, reference should be made to the ensuing detailed description and accompanying drawings.

BRIEF DESCRIPTION OF THE DRAWINGS

The invention will be described with reference to the accompanying drawings, wherein like numbers reference like elements.

DETAILED DESCRIPTION

In the following description, various embodiments of the present invention will be described. For purposes of description, specific configurations and details are set forth in order to provide a thorough understanding of the embodiments. However, it will also be apparent to one skilled in the art that the present invention may be practiced without the specific details. Furthermore, well-known features may be omitted, or simplified in order not to obscure the embodiment being described.

Figure 1:
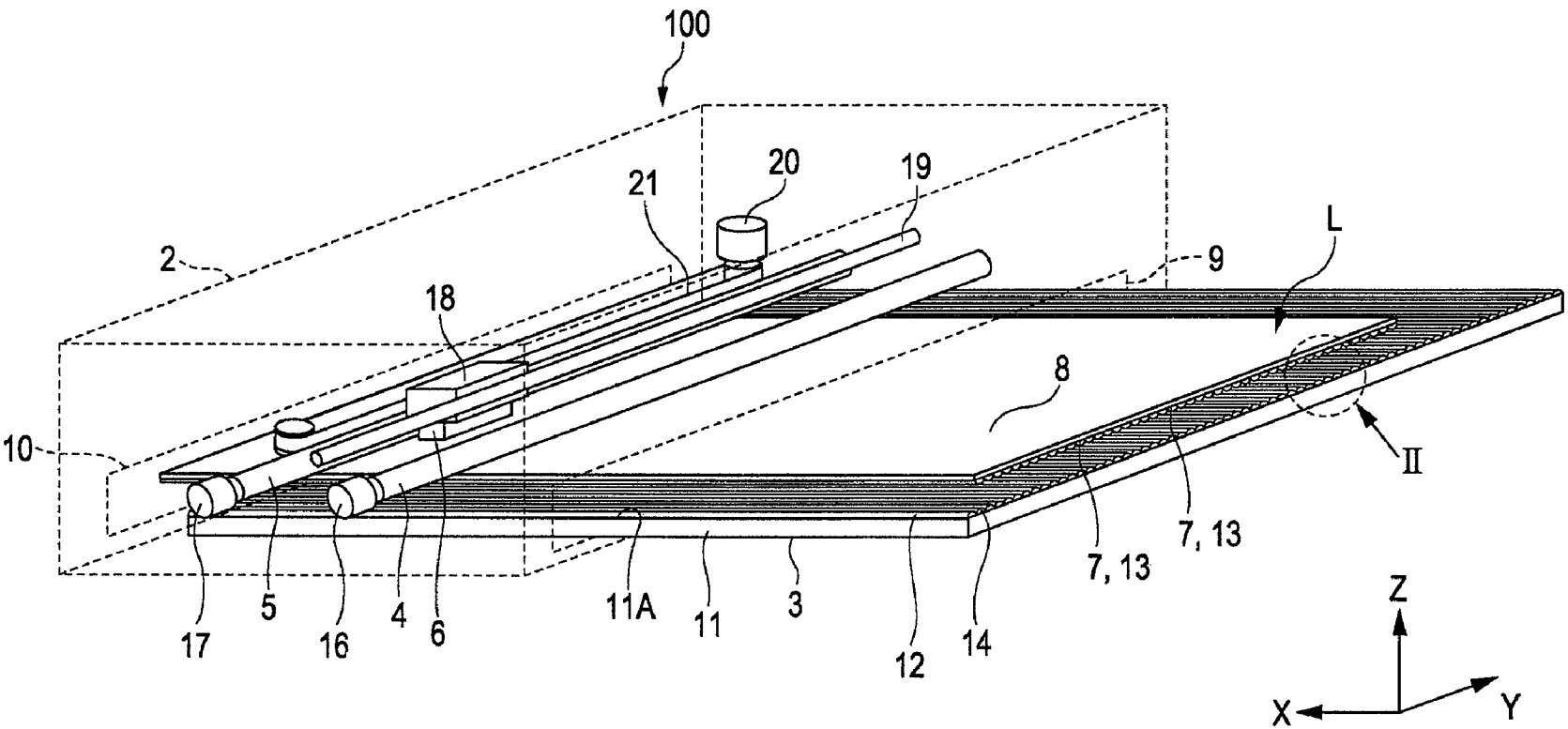
FIG. 1 is a rear-perspective view that schematically illustrates a recording apparatus and an interfacing recording target medium, in accordance with the embodiments of the present invention.
Figure 2:
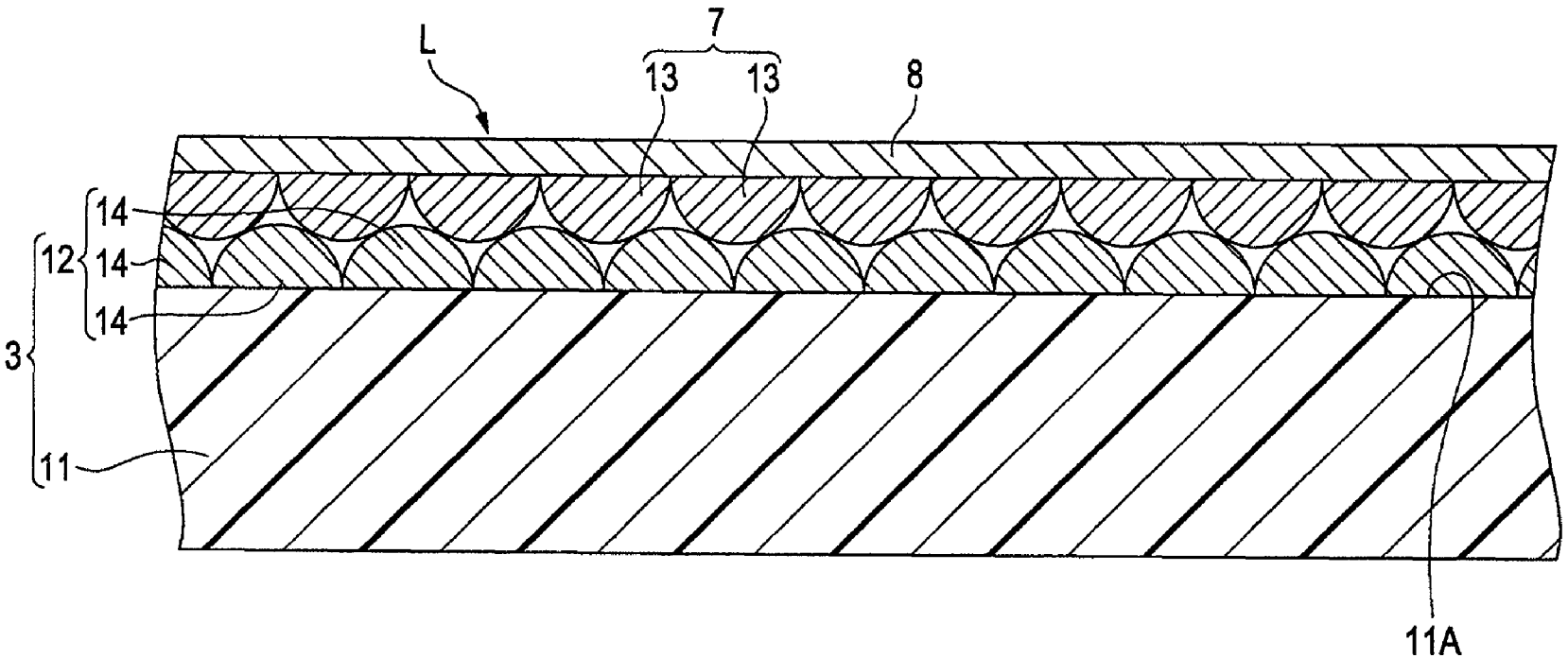
FIG. 2 is an enlarged cross-sectional view of area II of FIG. 1 illustrating engagement between a guided-array portion of the recording target medium and a guiding-array portion of the recording apparatus.
Figure 3:
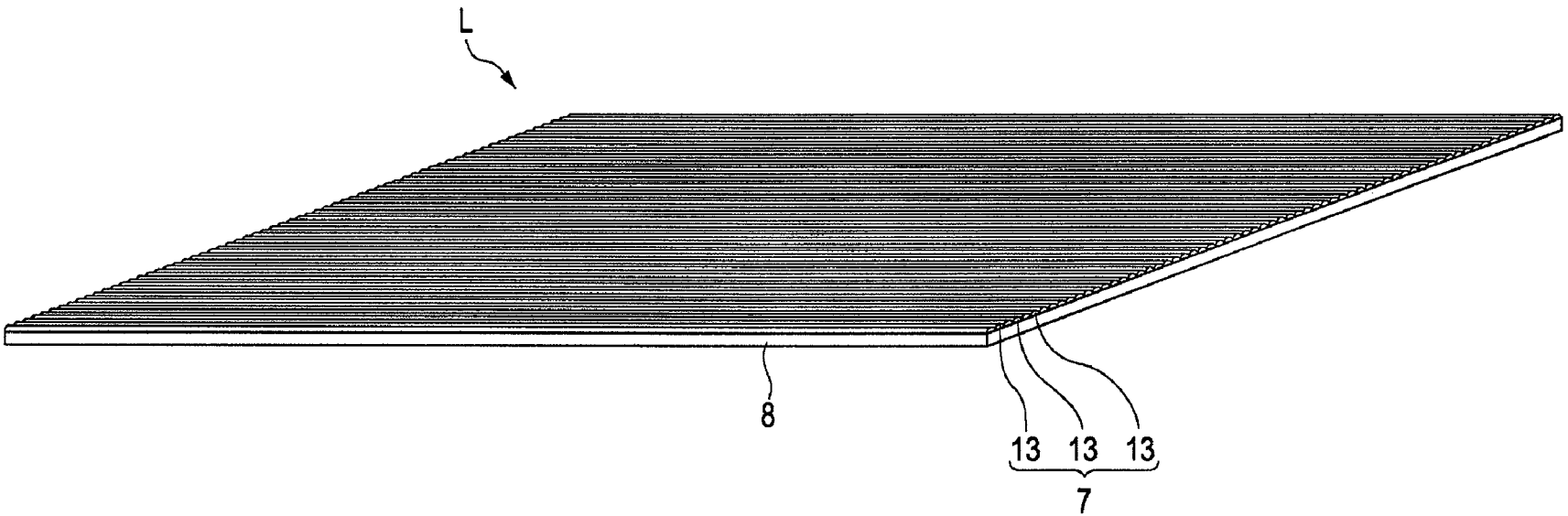
FIG. 3 is a perspective view that schematically illustrates an exemplary structure of a recording target medium in accordance with the embodiments of the present invention.

Referring now to the drawings, in which like reference numerals represent like parts throughout the several views, FIGS. 1, 2, and 3 show a recording target medium (L) and a recording apparatus 100, in accordance with the embodiments of the present invention.

FIG. 1 is a rear-perspective view that schematically illustrates the recording apparatus 100 on which the recording target medium (L) is placed. FIG. 2 is an enlarged cross-sectional view of area II of FIG. 1 illustrating engagement between a guided-array portion 7 of the recording target medium (L) and a guiding-array portion 12 of the recording apparatus 100. In FIG. 1, a frontward direction, that is, a direction from the rear of the recording apparatus 100 toward the front thereof, is indicated with an arrow X. The arrowed direction X is a direction in which the recording target medium (L) is transported. The direction opposite to the arrowed direction X is defined as a rearward direction, that is, a direction from the front of the recording apparatus 100 toward the rear thereof. When viewed in the direction from the rear of the recording apparatus 100 toward the front thereof, a direction from the left-hand side of the recording apparatus 100 toward the right-hand side thereof is defined as a rightward direction. The rightward direction is indicated with an arrow Y. A direction from the right-hand side of the recording apparatus 100 toward the left-hand side thereof is defined as a leftward direction. A direction from the bottom of the recording apparatus 100 toward the top thereof, which is shown by an arrow Z, is defined as a bottom-to-top direction (upward direction). The opposite direction is a top-to-bottom direction (downward direction). In the following description of this specification, the terms "frontward", "rearward", "leftward", "rightward", "bottom-to-top", "top-to-bottom" and similar expression may be used on the basis of the three-dimensional directions defined above while referring to FIG. 1. FIG. 3 is a perspective view that schematically illustrates an example of the structure of the recording target medium (L). A guided-array surface of the recording target medium (L), which is the surface at which a guided-array portion 7 is formed, is shown in FIG. 3.

The recording apparatus 100 includes a case 2, a sheet guide 3, a feeding roller 4, an ejecting roller 5, a recording head 6, and the like. The case 2 is an outer casing. The sheet guide 3, which is disposed under the illustrated recording target medium sheet (L) to support the reverse side thereof, is an example of a supporting section according to an aspect of the invention. The feeding roller 4 transports the recording target medium (L) placed on the sheet guide 3 in the frontward direction. The feeding roller 4 is a rotatable roller, which is a kind of a pressing section according to an aspect of the invention. The ejecting roller 5 is also a rotatable roller, which is a kind of the pressing section according to an aspect of the invention. The recording head 6 performs recording on the recording target medium (L).

The base material of the recording target medium (L) can be a resin sheet or a metal sheet. As illustrated in FIG. 3, one surface of the recording target medium (L) is formed as the guided-array portion 7. An image-formation layer 8 is formed at the other surface of the recording target medium (L). The image-formation layer 8 is an example of a recording portion according to an aspect of the invention. The guided-array portion 7 illustrated in FIG. 3 is made up of an array of guided portions 13 each of which has a semi-cylindrical shape. The guided portions 13 extend in the direction of the transportation of the recording target medium sheet (L). The guided portions 13 are arranged in parallel lines each of which has the same length as that of the recording target medium sheet (L).

The shape of the guided-array portion 7 is not limited to an array of semi-cylindrical convexes. Alternate shapes can be used as long as the guided portions 13 mesh with suitably shaped guiding portions 14, which are described below. For example, the guided-array portion 7 can have the shape of an array of semi-cylindrical concaves, triangles, or other convexes or concaves. The guided-array portion 7 can be colorless and transparent. The guided-array portion 7 can also be colored. For example, if the color of the guided-array portion 7 is white, the sense and/or degree of whiteness of the recording target medium (L) and its glossiness improve. If the color of the guided-array portion 7 is silver, it may have a glossy metallic appearance.

The image-formation layer 8 can be made up of a plurality of layers including, for example, an ink-accepting layer, an ink-absorbing layer, a resin coat layer, and a base paper layer. In many embodiments, the recording target medium (L) does not have the image-formation layer 8. For example, the guided-array portion 7 can be formed at one surface of a resin sheet or a metal sheet, and an image can be recorded directly on the opposite surface of the resin or metal sheet.

A feeding opening 9 through which the recording target medium (L) is fed into the case 2 is formed in the rear plate of the case 2. An ejecting opening 10 through which the recording target medium (L) is ejected out of the case 2 is formed in the front plate of the case 2. The recording target medium (L) that has been supplied to the recording apparatus 100 through the feeding opening 9 is transported in the frontward direction by the feeding roller 4 and the ejecting roller 5. The recording head 6 records an image on the recording target medium (L). Thereafter, the recording target medium (L) is ejected out of the recording apparatus 100 through the ejecting opening 10.

The sheet guide 3 is disposed below the feeding roller 4 and the ejecting roller 5. The sheet guide 3 is formed as a substantially rectangular plate. The rear edge of the sheet guide 3 is located behind the feeding opening 9. That is, the sheet guide 3 protrudes in the rearward direction through the feeding opening 9. The front edge of the sheet guide 3 is disposed between the ejecting opening 10 and the ejecting roller 5. The width of the sheet guide 3, that is, the horizontal dimension thereof viewed in the leftward/rightward direction, is large enough so that the sheet guide 3 can support the recording target medium (L) throughout the entire width of the recording target medium (L) transported on the sheet guide 3. The sheet guide 3 is fixed to the case 2 or other inner structure such as a frame by means of a fixation member that is not illustrated in the drawing.

The sheet guide 3 includes a substrate 11 and a guiding-array portion 12. The substrate 11 can be made of resin. The substrate 11 has the shape of a plate. The guiding-array portion 12 is formed on the upper surface 11A of the substrate 11. The upper surface 11A of the substrate 11 is a surface at which the recording target medium (L) is supported. The upper surface 11A of the substrate 11 is an example of a supporting surface according to an aspect of the invention. The guiding-array portion 12 is made up of an array of the guiding portions 14. The guiding portions 14 are arranged next to one another. The entire width of the array of the guiding portions 14 is larger than the entire width of the array of the guided portions 13 of the recording target medium (L). In the embodiments described herein, the shape of the guiding portion 14 is the same as that of the guided portion 13. However, the shapes of the guiding portion 14 and the guided portion 13 can differ as long as they interface in a manner that provides suitable guidance to the recording target medium (L). The recording target medium (L) is transported in a predetermined transportation direction along the direction of the length of the guiding portions 14, which is the direction of the ridgeline of each guiding portion 14. In other words, the ridgeline of each guiding portion 14 is orthogonal to the feeding roller 4 and the ejecting roller 5.

A lenticular lens sheet that has a semi-cylindrical array structure can be used for the guiding-array portion 12 of the sheet guide 3. In addition, a lenticular lens sheet that has a semi-cylindrical array structure can be used for the guided-array portion 7 of the recording target medium (L). For example, a lenticular lens sheet that has a semi-cylindrical array structure can be bonded to the upper surface 11A of the substrate 11 with the semi-cylindrical array surface facing upward. Ink-jet photo paper can be used as the image-formation layer 8. The other surface of another lenticular lens sheet, which is not the semi-cylindrical array surface, can be bonded to the non-printing surface of the photo paper. With the use of lenticular lens sheets, it is possible to easily form the guided-array portion 7 and the guiding-array portion 12.

Where the substrate 11 is formed by means of a resin molding method, a molding surface whose shape corresponds to the shape of the guiding-array portion 12 can be formed in a molding die in advance so that the guiding-array portion 12 and the substrate 11 are formed concurrently as an integrally-molded member. When the guiding-array portion 12 is molded as an integral part of the substrate 11 with the use of resin as a material as described above, it is preferable to use a low-friction resin material such as, for example, fluorocarbon resin for the formation of the substrate 11. If such a low-friction resin material is used, the friction between the recording target medium (L) and the guiding-array portion 12 may be reduced. With lower friction, the recording target medium (L) can be transported smoothly. The substrate 11 can be made of a metal plate. For example, the metal plate can be subjected to cutting, metal machining, or the like to form the guiding-array portion 12.

If the image-formation layer 8 has a multilayer structure that includes an ink-absorbing layer, a resin layer, a base paper layer, and another resin layer as in the layer structure of photo paper, the lower resin layer can double as the guided-array portion 7.

The ejecting roller 5 is disposed in front of the recording head 6. The feeding roller 4 is disposed behind the recording head 6. The feeding roller 4 rotates when driven by a feeding motor 16. The ejecting roller 5 rotates when driven by an ejecting motor 17. The feeding roller 4 and the ejecting roller 5 transport the recording target medium (L) placed on the sheet guide 3 in the frontward direction, that is, from the rear of the sheet guide 3 toward the front thereof.

The recording head 6 is mounted on the lower surface of a carriage 18. In many embodiments, the recording head 6 is an ink-jet recording head for ejecting ink. The carriage 18 is supported on a carriage guide 19 (e.g., a guiding shaft) as a movable member. The carriage guide 19 extends in the horizontal (i.e., leftward/rightward) direction. The carriage 18 is fixed to a timing belt 21, which is driven by a carriage motor 20. When the timing belt 21 is driven by the carriage motor 20, the recording head 6 travels in the horizontal direction along the carriage guide 19 together with the carriage 18.

The feeding roller 4 and the ejecting roller 5 transport the recording target medium (L) in the sub-scan direction, which is the transportation direction. The recording head 6 moves in the main-scan direction, which is the leftward/rightward direction. By controlling the transportation of the recording target medium (L) in the sub-scan direction and controlling the movement of the recording head 6 in the main-scan direction, it is possible to move the recording head 6 to any position over the recording target medium (L). Therefore, an image can be recorded at a desired position on the recording target medium (L). The recording target medium (L) is placed on the sheet guide 3 in such a manner so that the image-formation layer 8 faces toward the recording head 6 and so that the guided-array portion 7 is in contact with the guiding-array portion 12.

The recording apparatus 100 having the configuration described above records an image on the recording target medium (L) as follows. The recording target medium (L) is placed on the sheet guide 3 with the guided-array portion 7 facing the guiding-array portion 12. As illustrated in FIG. 2, when the recording target medium (L) is placed on the sheet guide 3, the guided portions 13, which constitute the guided-array portion 7, mesh with the guiding portions 14. Since the guided portions 13 mesh with the guiding portions 14, the guiding-array portion 12 fixes the horizontal position of the recording target medium (L), which is a position in the main-scan direction. Each guiding portion 14 extends along a predetermined transportation direction of the recording target medium (L). In other words, the direction of the ridgeline of the guiding portion 14 is orthogonal to the main-scan direction. Therefore, when the feeding roller 4 and the ejecting roller 5 transport the recording target medium (L), the recording target medium (L) moves in the direction orthogonal to the main-scan direction while being guided by the guiding-array portion 12. That is, since the ridgelines of the guiding portions 14 extend in a predetermined transportation direction of the recording target medium (L), which means the guiding direction of the guiding-array portion 12, the recording target medium (L) is transported in a stable transportation state in a fixed transportation direction. Since the recording target medium (L) is transported in a stable transportation state in a fixed transportation direction, the recording head 6 can record an image at a desired position on the recording target medium (L).

The clearance between the feeding roller 4 and the sheet guide 3 and the clearance between the ejecting roller 5 and the sheet guide 3 are set at a value that ensures that these rollers 4 and 5 apply a moderate pressing force onto the recording target medium (L). Since the recording target medium (L) is pressed against the sheet guide 3, secure engagement between the guided-array portion 7 and the guiding-array portion 12 is ensured. The secure engagement enhances horizontal transportation precision during the transportation of the recording target medium (L), that is, movement straightness in the transportation of the recording target medium (L).

For example, the guided-array portion 7 and the guiding-array portion 12 are more susceptible to disengagement when the recording target medium (L) is slightly curled or curved in the bottom-to-top direction (i.e., Z direction). The feeding roller 4 and the ejecting roller 5 press the recording target medium (L) against the sheet guide 3 so that the recording target medium (L) is kept in contact with the sheet guide 3. By this arrangement, it is possible to maintain engagement between the guided-array portion 7 and the guiding-array portion 12. If the recording target medium (L) is pressed against the sheet guide 3 with a pressing force that is too large, a resisting load due to friction between the recording target medium (L) and the sheet guide 3 may also be large, which may make it difficult to transport the recording target medium (L) smoothly. Therefore, the clearance between the feeding roller 4 and the sheet guide 3 as well as between the ejecting roller 5 and the sheet guide 3 can be set at a value that ensures that these rollers 4 and 5 apply a moderate pressing force onto the recording target medium (L) with due consideration given to a transportation burden (e.g., friction between the recording target medium (L) and the sheet guide 3) that does not make it difficult to transport the recording target medium (L) smoothly. The moderate pressing force can be large enough to keep the secure engagement of the guided-array portion 7 and the guiding-array portion 12.

The base roller surface of each of the feeding roller 4 and the ejecting roller 5 can be covered with a thick elastic rubber material. Because of the elastic rubber, the cover surface of each of the feeding roller 4 and the ejecting roller 5 can be elastically deformed. In addition, the clearance between the feeding roller 4 and the sheet guide 3 and the clearance between the ejecting roller 5 and the sheet guide 3 are set smaller than the thickness of the recording target medium (L). Accordingly, the feeding roller 4 and the ejecting roller 5 press the recording target medium (L) against the sheet guide 3. With such a configuration, when the recording target medium (L) passes between the feeding roller 4 and the sheet guide 3, the contact region of the surface of the feeding roller 4 that is currently in contact with the recording target medium (L) becomes elastically deformed, for example, slightly flattened. The same surface deformation due to elasticity occurs when the recording target medium (L) passes between the ejecting roller 5 and the sheet guide 3. The recording target medium (L) is transported while being pressed against the sheet guide 3 under a reaction force of elastic deformation as the feeding roller 4 and the ejecting roller 5 rotate. The spring rate of the rubber material, the thickness of the rubber material, the clearance between the feeding roller 4 and the sheet guide 3, and the clearance between the ejecting roller 5 and the sheet guide 3 can be modified as needed. Therefore, the feeding roller 4 and the ejecting roller 5 can apply a moderate pressing force onto the recording target medium (L) to maintain secure engagement between the guided-array portion 7 and the guiding-array portion 12 without making it difficult to transport the recording target medium (L) smoothly.

When the surface of each of the feeding roller 4 and the ejecting roller 5 is formed as a rubber surface that can be elastically deformed as described above, it is possible to set the clearance between the feeding roller 4 and the sheet guide 3 and the clearance between the ejecting roller 5 and the sheet guide 3 at a value that allows a paper medium such as copy paper to be transported therebetween. The thickness of a paper medium such as copy paper is approximately 0.1 mm. In contrast, the thickness of the recording target medium (L) is relatively large, for example, approximately 0.5 mm because the recording target medium (L) includes the guided-array portion 7. The clearance can be set small enough so that such a paper medium can be transported therebetween. By this setup, when a target medium is paper, it is possible to transport the paper medium. When a target medium is a recording target medium (L) as described herein that has a larger thickness, the contact region of the surface of each of the feeding roller 4 and the ejecting roller 5 that is currently in contact with the recording target medium (L) becomes elastically deformed to a greater extent. As a result, the recording target medium (L) is transported while being pressed against the sheet guide 3 under a reaction force of elastic deformation of the rubber material.

The length of the feeding roller 4 is preferrably larger than the width of the recording target medium (L). In addition, the length of the ejecting roller 5 is preferrably larger than the width of the recording target medium (L). Therefore, the recording target medium (L) can be pressed against the guiding-array portion 12 with uniform pressure throughout a wide area, which further secures engagement between the guided-array portion 7 and the guiding-array portion 12.

Next, with reference to FIG. 4, an exemplary recording apparatus 200 in accordance with another embodiment is described below.

Figure 4:
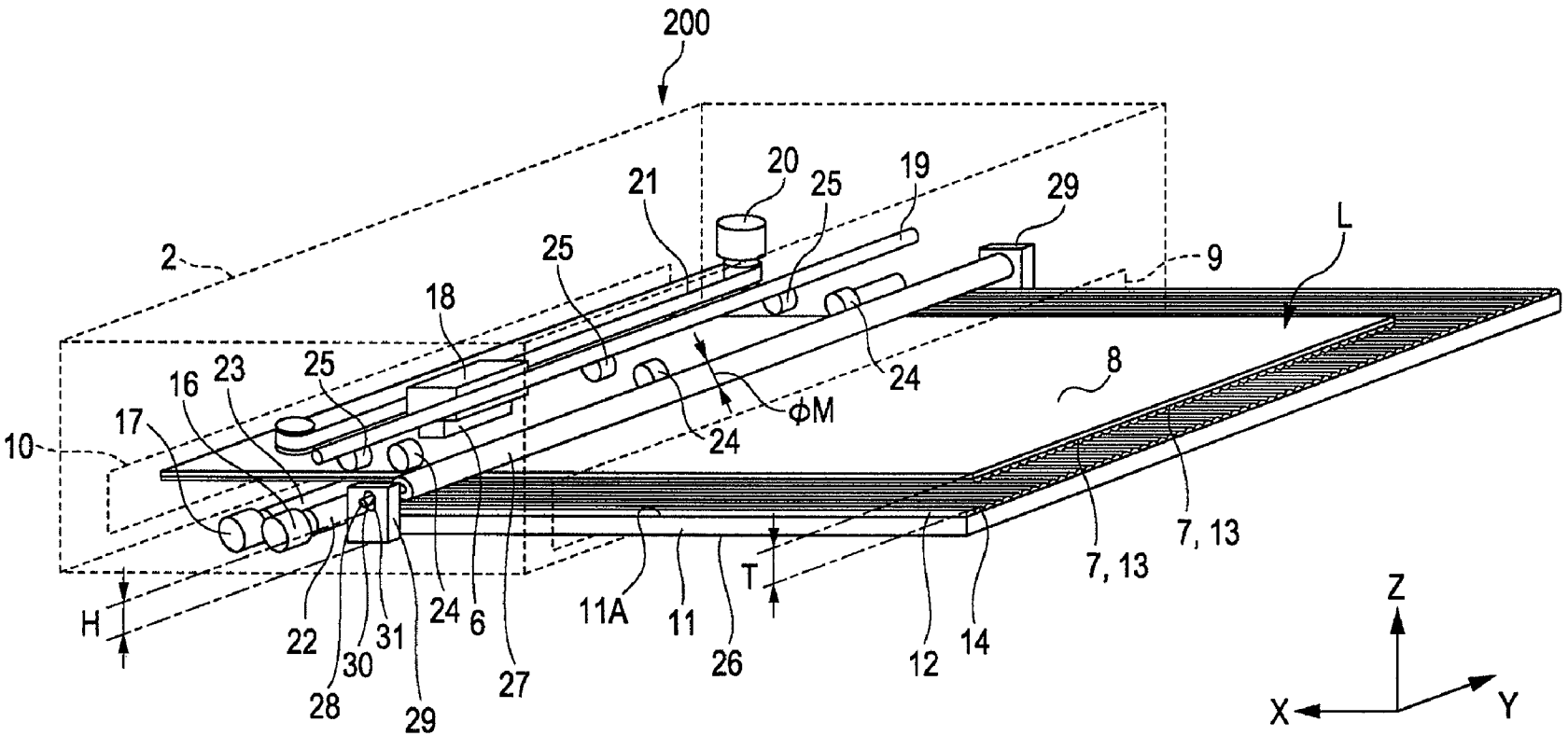
FIG. 4 is a rear-perspective view that schematically illustrates an exemplary recording apparatus in accordance with the embodiments of the present invention.

FIG. 4 is a rear-perspective view that schematically illustrates the recording apparatus 200. In the following description of the recording apparatus 200, the same reference numerals are consistently used for the same components as those of the recording apparatus 100 so as to omit any redundant description or simplify description thereof.

In the recording apparatus 100, the feeding roller 4 and the ejecting roller 5 are disposed over the recording target medium (L) that is transported. In contrast, in the recording apparatus 200, a feeding roller 22 and an ejecting roller 23, which transports the recording target medium (L), are disposed under the recording target medium (L). Three feeding-side driven rollers 24 are disposed over the feeding roller 22. The feeding-side driven rollers 24 are slave rollers that rotate as driven by the rotation of the feeding roller 22. The feeding-side driven rollers 24 are arranged in the horizontal direction. Three ejecting-side driven rollers 25 are disposed over the ejecting roller 23. The ejecting-side driven rollers 25 are slave rollers that rotate as driven by the rotation of the ejecting roller 23. The ejecting-side driven rollers 25 are arranged in the horizontal direction. The recording target medium (L) is transported while being pinched between the feeding roller 22 and the feeding-side driven rollers 24 as well as between the ejecting roller 23 and the ejecting-side driven rollers 25.

A pressing roller 27 is disposed behind the feeding roller 22. The pressing roller 27 presses the recording target medium (L) against a sheet guide 26. The pressing roller 27 is a rotatable roller, which is a kind of the pressing section according to an aspect of the invention. The pressing roller 27 can be made of metal such as stainless steel, brass, or the like. The length of the pressing roller 27 is preferrably larger than the width of the recording target medium (L). A shaft 28 protrudes from the left end face and the right end face of the pressing roller 27.

A bearing 29 is disposed at each of the left end and the right end of the pressing roller 27. Each of these bearings 29 has a bearing hole 30. The shaft 28 of the pressing roller 27 is inserted through the bearing hole 30 at each end. Accordingly, the bearings 29 support the pressing roller 27 rotatably. The bearing hole 30 has the shape of an oval that has a larger diameter in the Z direction. This means that the bearings 29 support the pressing roller 27 in such a manner that the pressing roller 27 can change its Z position.

The sheet guide 26 is disposed under the pressing roller 27. As described above, the front edge of the sheet guide 3 of the recording apparatus 100 described above is located in front of the ejecting roller 5. In contrast, the front edge of the sheet guide 26 of the recording apparatus 200 is located behind the feeding roller 22. Specifically, the front edge of the sheet guide 26 is disposed at a two-dimensional position between the feeding roller 22 and the pressing roller 27. Except for the above difference, the sheet guide 26 is the same as the sheet guide 3.

The height H of the lowest point 31 of the Z-elliptical bearing hole 30 measured from the sheet guide 26 as well as the diameter M of the pressing roller 27 can be set as follows: when the shaft 28 of the pressing roller 27 is supported on the lowest point 31 of the bearing hole 30, the clearance between the sheet guide 26 and the pressing roller 27 is smaller than a distance (T) between the upper surface of the recording target medium (L) that is placed on the sheet guide 26 and the top of the guiding portions 14. For this reason, when the recording target medium (L) is fed into a gap between the pressing roller 27 and the sheet guide 26, the recording target medium (L) lifts the pressing roller 27 upward. Therefore, the pressing roller 27 presses the recording target medium (L), which is transported over the sheet guide 26, against the sheet guide 26. When the recording target medium (L) is transported in the frontward direction by the feeding roller 22 and the ejecting roller 23, the pressing roller 27 rotates on its shaft 28 to follow the movement of the recording target medium (L). Thus, it is possible to press the recording target medium (L) against the sheet guide 26 without involving a substantial increase in the transportation burden of the recording target medium (L). In addition, the recording target medium (L) is transported without causing significant friction with the pressing roller 27.

In the operation of the recording apparatus 200, as in the operation of the recording apparatus 100, the recording target medium (L) is transported in a stable transportation state in a fixed transportation direction, that is, along the guiding direction of the guiding-array portion 12. Therefore, the recording head 6 can record an image at a desired position on the recording target medium (L). In addition, the pressing roller 27 presses the recording target medium (L) against the sheet guide 26, which secures engagement between the guided-array portion 7 and the guiding-array portion 12. Therefore, positional precision in the recording of an image on the recording target medium (L) may be enhanced.

Moreover, since the length of the pressing roller 27 is preferrably larger than the width of the recording target medium (L), the recording target medium (L) can be pressed against the guiding-array portion 12 with uniform pressure throughout a wide area, which further secures engagement between the guided-array portion 7 and the guiding-array portion 12.

Next, with reference to FIG. 5, an exemplary recording apparatus 300 in accordance with another embodiment is described below.

Figure 5:
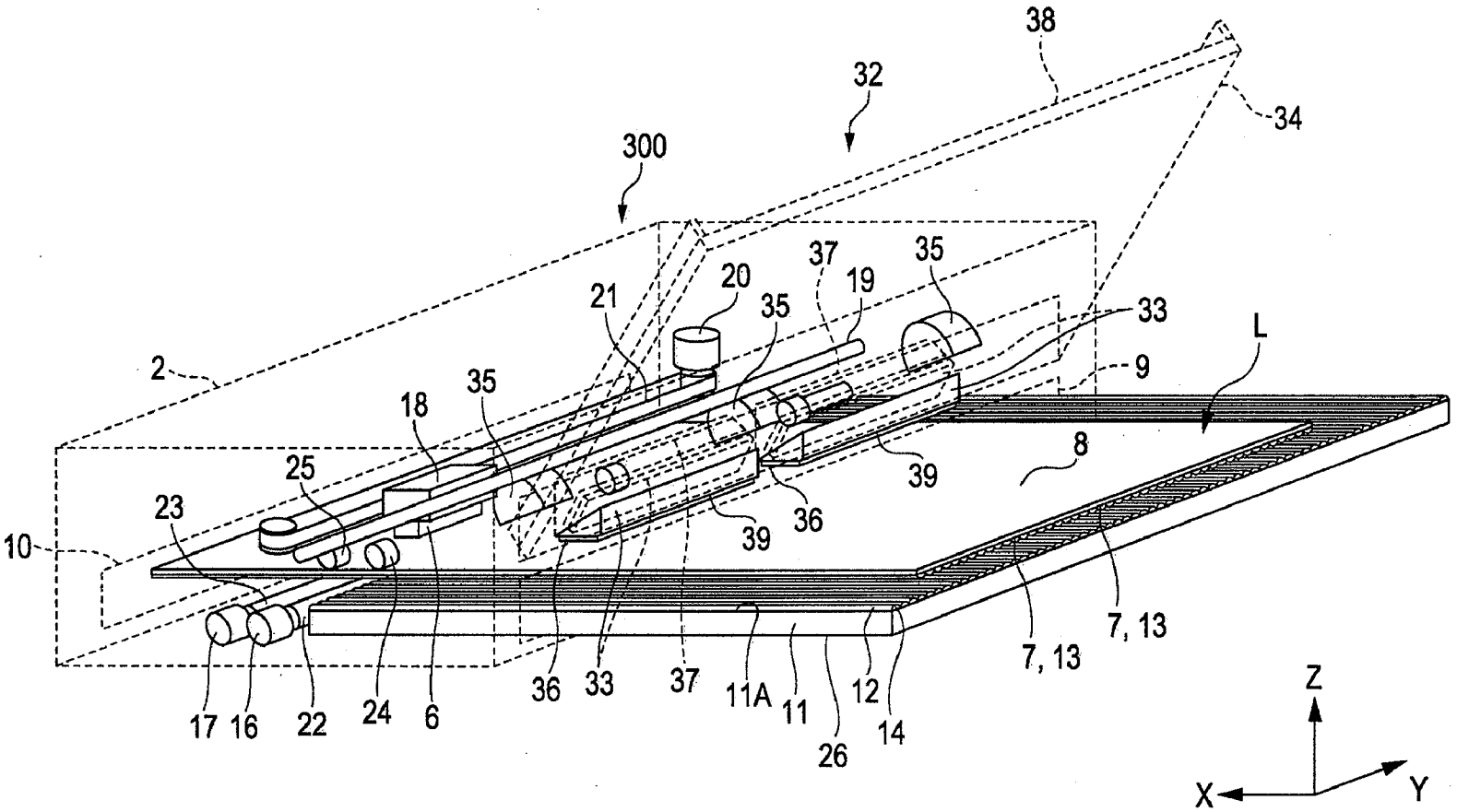
FIG. 5 is a rear-perspective view that schematically illustrates an exemplary recording apparatus in accordance with the embodiments of the present invention.

FIG. 5 is a rear-perspective view that schematically illustrates the recording apparatus 300. In the following description of the recording apparatus 300, the same reference numerals are consistently used for the same components as those of the recording apparatus 100 and the recording apparatus 200 described above so as to omit any redundant description or simplify description thereof.

The recording apparatus 300 uses paper holders 33 of a sheet feeding mechanism 32 for pressing the recording target medium (L) against the sheet guide 26. The sheet feeding mechanism 32 includes a paper stacker 34, the paper holders 33, pickup rollers 35, and the like. Multiple sheets of paper, which are not illustrated in the drawing, can be stacked one on another on the paper stacker 34. The paper stacker 34 is a kind of a supporting unit. The pickup rollers 35 draw one sheet of paper at a time sequentially to feed each sheet to the feeding roller 22. The paper holders 33 hold the sheets of paper stacked on the paper stacker 34 to prevent the sheets from slipping down toward the front of the sheet guide 26 excluding one sheet that is currently taken out by the pickup rollers 35.

As illustrated in FIG. 5, three pickup rollers 35 are disposed at equal horizontal spaces. Two paper holders 33 are disposed at positions corresponding to the respective spaces. A turning mechanism that is not illustrated in the drawing turns each paper holder 33. The paper holder 33 can pivot upward and downward on its front edge 36. When the sheet feeding mechanism 32 is in use, that is, when sheets of paper (not illustrated) are stacked on the paper stacker 34, each paper holder 33 is set at an upper position shown by dotted lines in FIG. 5. When the paper holder 33 is set at the upper position, the rear face 37 of the paper holder 33 projects over the paper-stacking surface 38 of the paper stacker 34. The rear face 37 prevents the sheets (not illustrated) stacked on the paper stacker 34 from slipping in the frontward and downward direction.

When the sheet feeding mechanism 32 is not in use, that is, when no sheet of paper is stacked on the paper stacker 34, each paper holder 33 is set at a lower position shown by solid lines in FIG. 5. The lower position is hereinafter referred to as a lens-sheet-holding position. At the bottom of the paper holder 33 is a felt surface 39, which is a surface to which felt is bonded.

When the paper holder 33 is set at the lens-sheet-holding position, the felt surface 39 of the paper holder 33 faces the sheet guide 26. When the recording target medium (L) is placed on the sheet guide 26, the felt surface 39 of the paper holder 33 set at the lens-sheet-holding position faces the recording target medium (L). An urging member such as a spring urges the paper holder 33 downward. The urging member is not illustrated in the drawing. Because of the downward urging force, when the sheet feeding mechanism 32 is not in use, the paper holder 33 set at the lens-sheet-holding position presses the recording target medium (L) against the sheet guide 26.

The downward urging force applied by the urging means to the paper holder 33 is set small enough so as not to apply a large braking force against the transportation of the recording target medium (L) but large enough so as to secure the engagement of the guided-array portion 7 of the recording target medium (L) and the guiding-array portion 12 of the sheet guide 26. As in the operation of the recording apparatus 100 and the recording apparatus 200 described above, the recording target medium (L) is transported in a stable transportation state in a fixed transportation direction, that is, along the guiding direction of the guiding-array portion 12. Therefore, the recording head 6 can record an image at a desired position on the recording target medium (L). When the recording target medium (L) is transported while being pressed by the paper holder 33, the image-formation layer 8 is rubbed against the felt surface 39. However, since the felt surface 39 is soft and has low frictionality, the image-formation layer 8 is not damaged during the transportation.

Detection of Transportation Angle

It is possible to record an image at a desired position on the recording target medium (L) if, for example, the sheet guide 3, 26 is mounted on the case 2 with accurate alignment. Specifically, if the sheet guide 3, 26 is mounted precisely in such a manner that the guiding direction of the guiding-array portion 12 extends exactly along the predetermined transportation direction of the recording target medium (L), recording is performed at the desired position. In other words, if the guiding direction of the guiding-array portion 12 is exactly orthogonal to the main-scan direction (i.e., the extending direction of the feeding roller 4, 22 and the ejecting roller 5, 23), the recording position is precise. However, if the sheet guide 3, 26 is mounted on the case 2 with inaccurate alignment, which means that the guiding direction of the guiding-array portion 12 is not exactly orthogonal to the main-scan direction, the recording target medium (L) that is transported on the sheet guide 3, 26 moves obliquely. As a result, the horizontal position of the recording target medium (L) changes as the recording target medium (L) is transported. The displacement (i.e., change in terms of position) of the recording target medium (L) occurs either toward the left or the right, which depends on the direction of oblique movement. For this reason, an image may not be recorded at the desired position on the recording target medium (L). Although the recording target medium (L) is transported obliquely in such a case, the oblique movement of the recording target medium (L) is fixed because the guiding-array portion 12 guides the recording target medium (L) during the transportation. That is, the leftward displacement of the recording target medium (L), or the rightward displacement thereof, is proportional to the transportation distance of the recording target medium (L). Therefore, even in a case where the recording target medium (L) is transported obliquely, it is still possible to record an image at a desired position on the recording target medium (L) by measuring an inclination angle that is defined by the guiding direction of the guiding-array portion 12 and the predetermined transportation direction of the recording target medium (L) in advance and then by correcting image data for recording (i.e., recording data) in accordance with the inclination angle.

Figure 6:
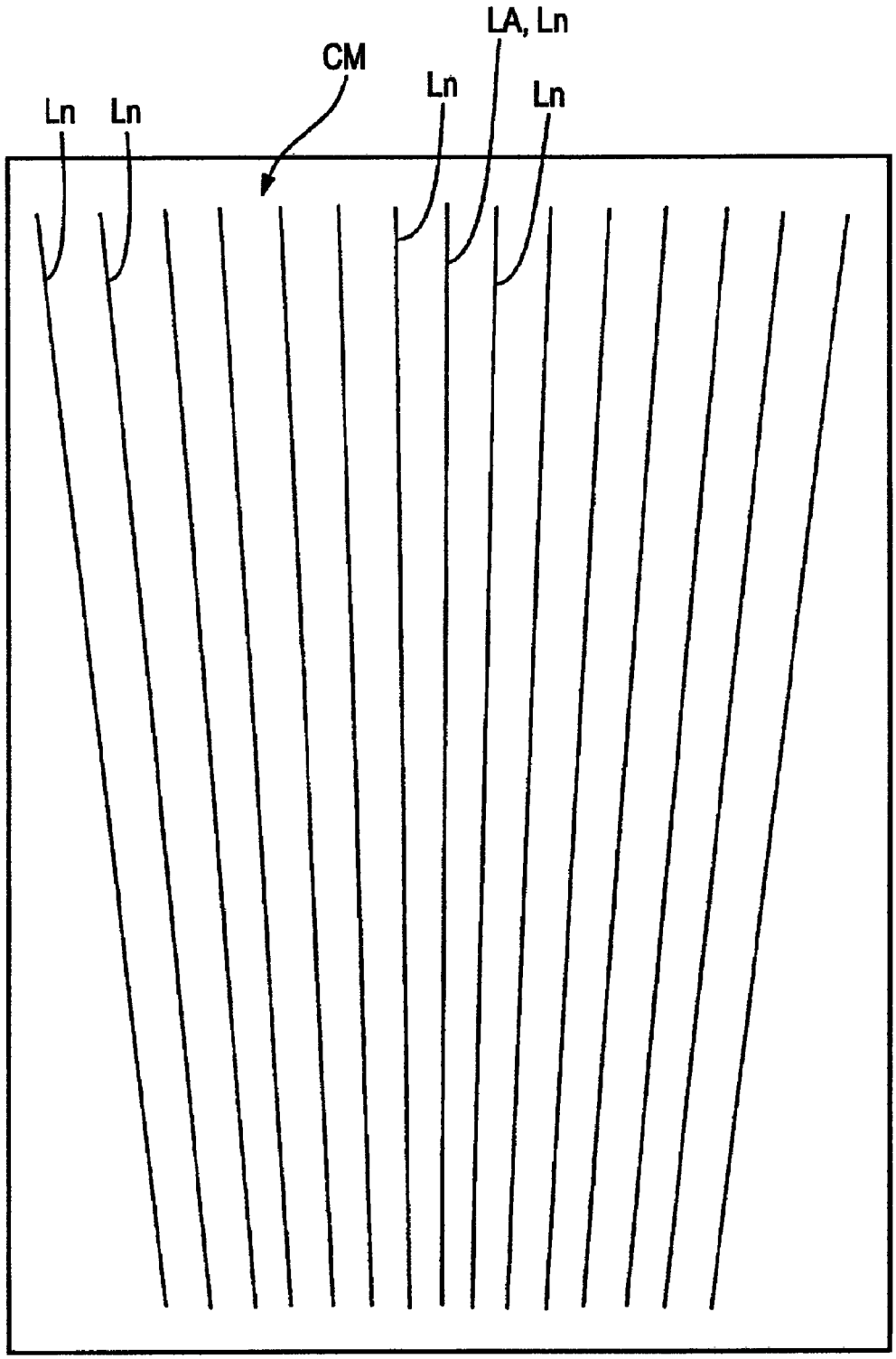
FIG. 6 is a diagram that schematically illustrates an exemplary test image that can be printed to a recording target medium to determine the orientation of a guiding-array of a recording apparatus, in accordance with the embodiments of the present invention.

The inclination angle can be measured as follows. The recording apparatus 300 records a test image CM on the recording target medium (L). The test image CM, which is an image used for testing purpose, is made up of a plurality of lines (Ln) as illustrated in FIG. 6. These lines (Ln) have cumulative inclination. The centerline (LA) among the lines (Ln) is a line that extends in the predetermined nominal transportation direction. Left lines (Ln), which are arranged to the left of the centerline (LA), are inclined with a fixed incremental angle in a cumulative manner in a certain angular direction whereas right lines (Ln), which are arranged to the right of the centerline (LA), are inclined with the same incremental angle in a cumulative manner in a different angular direction.

Figure 7:
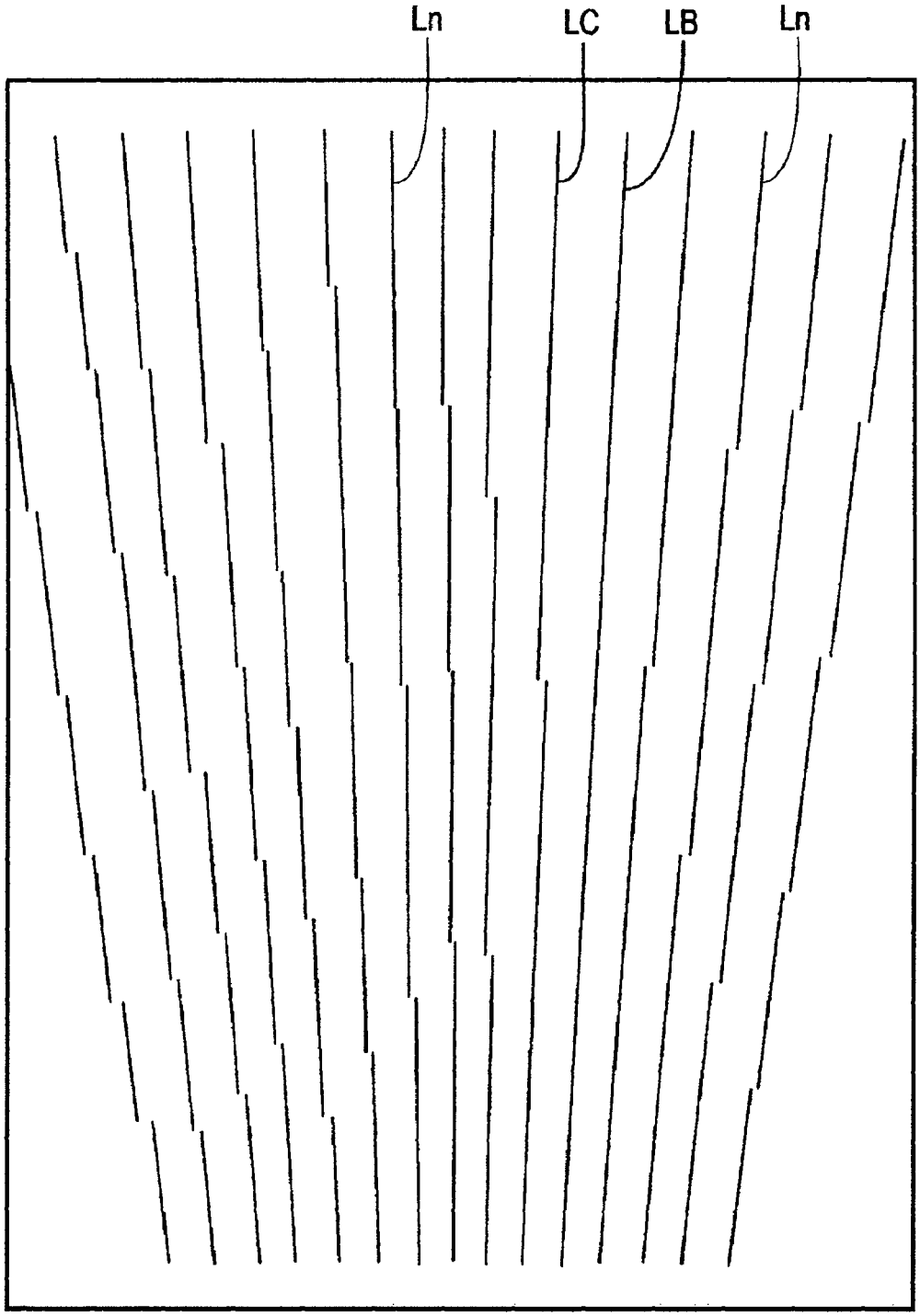
FIG. 7 is a diagram that schematically illustrates the test image of FIG. 6 as printed on a recording target medium, in accordance with the embodiments of the present invention.

For example, the lines (Ln) that are arranged to the left of the centerline (LA) can be inclined with an incremental angle of 0.01°. The inclination increases in a cumulative manner in a counterclockwise direction with respect to and viewed from the transportation direction. The lines (Ln) that are arranged to the right of the centerline (LA) can be inclined with the same incremental angle of 0.01°. The inclination increases in a cumulative manner in a clockwise direction with respect to and viewed from the transportation direction. The test image CM is recorded on the recording target medium (L) that is transported while being guided by the guiding-array portion 12 on the basis of the testing image data described above. FIG. 7 shows the test image CM recorded on the recording target medium (L) viewed from the guided array portion 7 side. As illustrated therein, a line (LB) is visually recognized as a continuous single line. The line (LB) is, among the plurality of lines (Ln), a line that is recorded along the ridgeline of the guided portion 13 of the guided-array portion 7. In contrast, each of the other lines (Ln) that is not recorded along the ridgeline of the guided portion 13 is discontinuous because it is recorded across more than one guided portion 13. For example, a line (LC) is visually recognized as split discontinuous line segments that are shifted in a horizontal direction.

Therefore, the inclination angle of the line (Ln) that corresponds to the line (LB), which is, among the plurality of lines (Ln), a line that can be visually recognized as a continuous single line viewed via the guided-array portion 7, can be measured as the inclination angle defined by the guiding direction of the guiding-array portion 12 and the predetermined transportation direction of the recording target medium (L). Then, recording image data is rotated on the basis of the measured inclination angle to generate corrected image data. Since an image is recorded on the recording target medium (L) on the basis of the corrected image data, it is possible to record an image at a desired position even in a case where the recording target medium (L) is transported obliquely.

As described above, the inclination angle of the guiding direction of the guiding-array portion 12 relative to the predetermined transportation direction of the recording target medium (L) can be measured with the use of one type of the test image CM that includes the lines (Ln) arranged with the incremental angle of 0.01°. As a modification example, two types of test images that are different from each other in terms of angular increment can be used for measuring the inclination angle of the guiding direction of the guiding-array portion 12. For example, a first test image that includes lines arranged with an incremental angle of 0.05° is recorded on a recording target medium (L). A line that has the greatest length in the test image viewed via the guided-array portion 7 is identified. Next, a second test image that includes lines arranged with an incremental angle of 0.01° is recorded on another recording target medium (L). The line identified as above is taken as the centerline of the plurality of lines that are arranged to the left of the centerline and to the right thereof. Thereafter, a line that has the greatest length in the second test image viewed via the guided-array portion 7 is identified. The inclination angle of the line is measured as the inclination angle defined by the guiding direction of the guiding-array portion 12 and the predetermined transportation direction of the recording target medium (L).

In this example, the inclination angle of the guiding direction of the guiding-array portion 12 is measured with the use of two types of test images. Therefore, the range of an inclination angle that can be measured widens. In addition to the wider measurement range, the inclination angle can be measured with high precision. That is, since the first test image that includes lines arranged with the incremental angle of 0.05° is used first, the range of an inclination angle that can be measured is wider in comparison with a case where the test image CM only, which includes lines arranged with the incremental angle of 0.01°, is used for measurement. Since the second test image that includes lines arranged with the incremental angle of 0.01° is used thereafter, the inclination angle can be measured with high precision. The measurable range of the transportation inclination angle further widens with high precision by increasing the number of test images.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A recording target medium, comprising:

a base material;

a recording portion that is formed on or at one surface of the base material, the recording portion including an ink-accepting layer; and a guided-array portion that is formed on the base material at a side opposite to an observation side of the recording portion, the guided-array portion having the shape of an array of triangles or concave semi-cylinders.

2. The recording target medium according to claim 1, wherein the guided-array portion is colored.

3. A recording apparatus for performing recording on a recording target medium that includes a base material; a recording portion that is formed on or at one surface of the base material, the recording portion including an ink-accepting layer; and a guided array portion that is formed on the base material at a side opposite to an observation side of the recording portion; the recording apparatus comprising:

a supporting section that supports the recording target medium;

a guiding-array portion that is formed on the supporting section, the guiding-array portion guiding the guided-array portion of the recording target medium; and a pressing section that presses the recording target medium against the guiding-array portion.

4. The recording apparatus according to claim 3, wherein the supporting section and the guiding-array portion are fabricated as an integral member.

5. The recording apparatus according to claim 4, wherein the integral member comprises a low-friction material.

6. The recording apparatus according to claim 4, wherein the integral member is molded from a fluorocarbon resin.

7. The recording apparatus according to claim 3, wherein:

the recording apparatus comprises a recording head that moves in a main-scan direction; and the guiding array portion is oriented to transport the recording target medium in a transport direction substantially orthogonal to the main-scan direction.

8. The recording apparatus according to claim 7, further comprising:

a feeding roller disposed after the recording head to feed the recording target medium to the recording head along the transport direction; and an ejecting roller disposed forward of the recording head to eject the target medium from the recording apparatus along the transport direction, wherein at least one of the feeding roller or the ejecting roller presses the recording target medium against the guiding-array portion to maintain alignment between the recording target medium and the guiding-array portion.

9. The recording apparatus according to claim 8, wherein a clearance between at least one of the feeding roller and the guiding-array portion or the ejecting roller and the guiding-array portion is smaller than a thickness of the recording target medium.

10. The recording apparatus according to claim 9, wherein the clearance is small enough to transport copy paper.

11. The recording apparatus according to claim 10, wherein at least one of the feeding roller or the ejecting roller becomes elastically deformed to a greater extent when transporting the recording target medium than when transporting copy paper.

12. The recording apparatus of claim 7, further comprising a sheet feeding mechanism that includes a paper stacker in which a plurality of sheets of paper can be stacked.

13. The recording apparatus according to claim 3, wherein the pressing section comprises a pressing roller that rotates in a rotation direction that agrees with a direction of transportation of the recording target medium.

14. The recording apparatus according to claim 13, wherein a clearance between the pressing roller and the guiding-array portion is selected so as to generate sufficient pressing force to maintain alignment between the guided-array portion and the guiding-array portion.

15. The recording apparatus according to claim 13, wherein the pressing roller is longer than the width of the recording target medium.

16. The recording apparatus according to claim 13, further comprising:

a driven feeding roller disposed under the recording target medium to transport the recording target medium;

a driven ejecting roller disposed under the recording target medium and forward of the feeding roller to transport the recording target medium;

a plurality of feeding-side rollers disposed over the recording target medium and over the feeding roller, the feeding-side rollers rotating in response to transportation of the recording target medium; and a plurality of ejecting-side rollers disposed over the recording target medium and over the ejecting roller, the ejecting-side rollers rotating in response to transportation of the recording target medium.

17. The recording apparatus according to claim 16, wherein:

the pressing roller is disposed aft of the feeding roller; and the pressing roller is supported so as to provide for different vertical positions of the pressing roller.

18. The recording apparatus according to claim 17, wherein the pressing roller is supported by bearings comprising an oval shaped hole with a larger dimension in the vertical direction.

19. The recording apparatus according to claim 18, wherein when the pressing roller is supported in its lowest vertical position a clearance between the guiding-array portion and the pressing roller is less than a distance between an upper surface of the recording target medium and the guiding-array portion when the recording target medium is supported by the guiding-array portion.

20. A method for measuring an inclination angle between the orientation of the guiding-array portion and the main-scan direction in a recording apparatus according to claim 7, the method comprising:

recording a first test image by using the recording apparatus to record the first test image on a recording target medium; the first test image comprising a plurality of first lines having cumulative inclination; the recording target medium including a base material; a recording portion that is formed on or at one surface of the base material, the recording portion including an ink-accepting layer; and a guided-array portion that is formed on the base material at a side opposite to an observation side of the recording portion;

identifying one of the plurality of recorded first lines as being the most continuous of the plurality of recorded first lines; and determining the inclination angle in response to the inclination angle of the identified recorded first line in the first test image.

21. The method according to claim 20, further comprising:

recording a second test image by using the recording apparatus to record the second test image on the recording target medium, the second test image comprising a plurality of second lines having lesser cumulative inclination than the first lines of the first test image;

identifying one of the plurality of recorded second lines as being the most continuous of the plurality of recorded second lines; and determining the inclination angle in response to the inclination angle of the identified second line in the second test image.

22. The method according to claim 21, wherein the second test image comprises a plurality of second lines having increased and decreased inclination angle relative to the identified recorded first line.

* * * * *